US006939437B1

(12) United States Patent
Hill, Jr. et al.

(10) Patent No.: US 6,939,437 B1
(45) Date of Patent: Sep. 6, 2005

(54) PAPER MAKING PROCESSES USING ENZYME AND POLYMER COMBINATIONS

(75) Inventors: Walter B. Hill, Jr., Germantown, TN (US); Richard L. Barclay, Holden, ME (US); James A. O'Malley, Zionsville, IN (US); Randall W. Conrod, Madawaska, ME (US); John Desjardins, Cordova, TN (US); Roger M. Plourde, Hampton, ME (US)

(73) Assignee: Buckman Laboratories International, Inc., Memphis, TN (US)

( * ) Notice: Subject to any disclaimer, the term of this patent is extended or adjusted under 35 U.S.C. 154(b) by 239 days.

(21) Appl. No.: 09/711,126

(22) Filed: Nov. 13, 2000

Related U.S. Application Data

(60) Provisional application No. 60/166,330, filed on Nov. 19, 1999.

(51) Int. Cl.[7] ..... D21H 11/20; D21H 25/02

(52) U.S. Cl. ..... 162/9; 162/72; 162/158; 162/168.2; 162/168.3; 162/182; 435/277

(58) Field of Search ..... 162/9, 72, 158, 162/168.2, 168.3, 182; 435/277, 278, 275

(56) References Cited

U.S. PATENT DOCUMENTS

| | | | | |
|---|---|---|---|---|
| 3,041,246 A | | 6/1962 | Bolaski et al. | 195/8 |
| 3,406,089 A | | 10/1968 | Yerkes, Jr. | 162/199 |
| 3,616,222 A | | 10/1971 | Dasinger | 195/31 |
| 3,972,775 A | | 8/1976 | Wilke et al. | 195/33 |
| 4,451,567 A | | 5/1984 | Ishibashi et al. | 435/170 |
| 4,894,119 A | | 1/1990 | Baron, Jr. et al. | 162/168.2 |
| 4,923,565 A | | 5/1990 | Fuentes et al. | 162/72 |
| 5,110,412 A | | 5/1992 | Fuentes et al. | 162/5 |
| 5,169,497 A | | 12/1992 | Sarkar et al. | 162/158 |
| 5,308,449 A | | 5/1994 | Fuentes et al. | 162/72 |
| 5,356,800 A | * | 10/1994 | Jaquess | 435/188 |
| 5,423,946 A | | 6/1995 | Sarkar et al. | 162/158 |
| 5,501,770 A | | 3/1996 | Sarkar et al. | 162/100 |
| 5,507,914 A | | 4/1996 | Sarkar et al. | |
| 5,879,509 A | | 3/1999 | Sharyo et al. | |

FOREIGN PATENT DOCUMENTS

| | | |
|---|---|---|
| CA | 758488 | 5/1967 |
| CA | 2007774 | 7/1990 |
| CA | 2030186 | 5/1991 |

(Continued)

OTHER PUBLICATIONS

Pilon, L., "Increasing Water Retention of Mechanical Pulp by Biological Treatments," *Tappi Journal*, Jun. 1982, vol. 65, No. 6, p. 93.

(Continued)

*Primary Examiner*—Stev Alvo
(74) *Attorney, Agent, or Firm*—Kilyk & Bowersox, P.L.L.C.

(57) ABSTRACT

Methods of making paper or paperboard are described. In one method, at least one cellulytic enzyme composition and at least one cationic polymer composition are introduced to a paper making pulp at about the same time to form a treated pulp. The pulp may also be treated with at least one cationic starch. The resulting pulp is formed into a sheet of pulp. Other paper making processes are also described. A paper making apparatus is also described for carrying out the methods. Paper and paperboard made according to the methods are also described.

32 Claims, 3 Drawing Sheets

FOREIGN PATENT DOCUMENTS

| | | | |
|---|---|---|---|
| CA | 2030836 | | 5/1991 |
| CA | 2039838 | | 10/1991 |
| CA | 2187757 | | 7/2000 |
| DE | 26 33 514 | A1 | 2/1978 |
| EP | 0 351 655 | A1 | 1/1990 |
| EP | 0 430 915 | A1 | 6/1991 |
| EP | 0 433 258 | A1 | 6/1991 |
| FR | 2 775 990 | | 9/1999 |
| WO | WO 91/11552 | | 8/1991 |
| WO | WO 94/20666 | | 9/1994 |
| WO | WO 95/27825 | | 10/1995 |
| WO | WO 99/43780 | A1 | 9/1999 |

OTHER PUBLICATIONS

Pommier, et al., "Using Enzymes To Improve The Process And Product Quality In The Recycled Paper Industry,"*Biotechnology, Tappi Journal*, Jun. 1989, pps 187 and 191.

* cited by examiner

PAPER MAKING PROCESSES USING ENZYME AND POLYMER COMBINATIONS

This application claims benefit under 35 U.S.C. § 119(e) of prior U.S. Provisional Application No. 60/166,330 filed Nov. 19, 1999, which is incorporated in its entirety by reference herein.

BACKGROUND OF THE INVENTION

The present invention relates to paper making processes and products made from these processes. More particularly, the present invention relates to treating paper making pulp with a cellulytic enzyme and one or more polymers.

Particular paper making processes using an enzymatic treatment of paper making pulp are described in, for example, U.S. Pat. No. 4,923,565 to Fuentes et al., U.S. Pat. No. 5,110,412 to Fuentes et al., U.S. Pat. No. 5,169,497 to Sarkar et al., and U.S. Pat. No. 5,308,449 to Fuentes et al., each of which is incorporated herein in its entirety by reference. According to these processes, a paper making pulp is contacted with an enzyme composition for a substantial period of time before the pulp is worked on a conventional paper making machine. According to these processes, the pulp must remain in contact with the enzyme composition for at least 20 minutes before the pulp can be treated with a conventional synthetic polymeric composition. The contact time allows the enzyme an adequate reaction period prior to addition of the synthetic polymer. Accordingly, the process requires a separate addition of the synthetic polymer downstream from where the enzyme first contacts the pulp, which is time consuming and complicated.

There is a need for a paper making process that is simplified and/or avoids the lengthy contact times.

SUMMARY OF THE INVENTION

The present invention provides a method of making paper or paperboard that includes introducing at least one cellulytic enzyme composition and at least one cationic polymer composition to a paper making pulp at about the same time, to form a treated pulp. The enzyme composition and polymer composition can be added to the pulp separately, or they can be pre-combined and then added. The pulp may also be further treated with at least one cationic starch. The resulting pulp is then formed into a sheet of pulp, preferably having improved drainage and/or retention properties compared to conventional treatments. After drainage and drying, the resulting paper or paperboard preferably exhibits excellent opaqueness and other physical properties.

The present invention further relates to a method of making paper or paperboard that includes treating pulp in a blend chest with a cationic polymer composition and then passing the treated pulp to a machine chest wherein an enzyme composition is added to the treated pulp. The enzyme-treated pulp is then refined and passed to a stuff box. From the stuff box, the pulp is then passed through a white water silo where a second cationic polymer composition is added to the pulp and then the pulp is formed into paper or paperboard.

The present invention also provides a paper making system for carrying out the above-described methods, and paper and paperboard made according to the methods.

It is to be understood that both the foregoing general description and the following detailed description are exemplary and explanatory only and are only intended to provide a further explanation of the present invention, as claimed.

The accompanying drawings, which are incorporated in and constitute a part of this application, illustrate several embodiments of the present invention and together with description, serve to explain the principles of the present invention.

DETAILED DESCRIPTION OF THE PRESENT INVENTION

Figure 1:
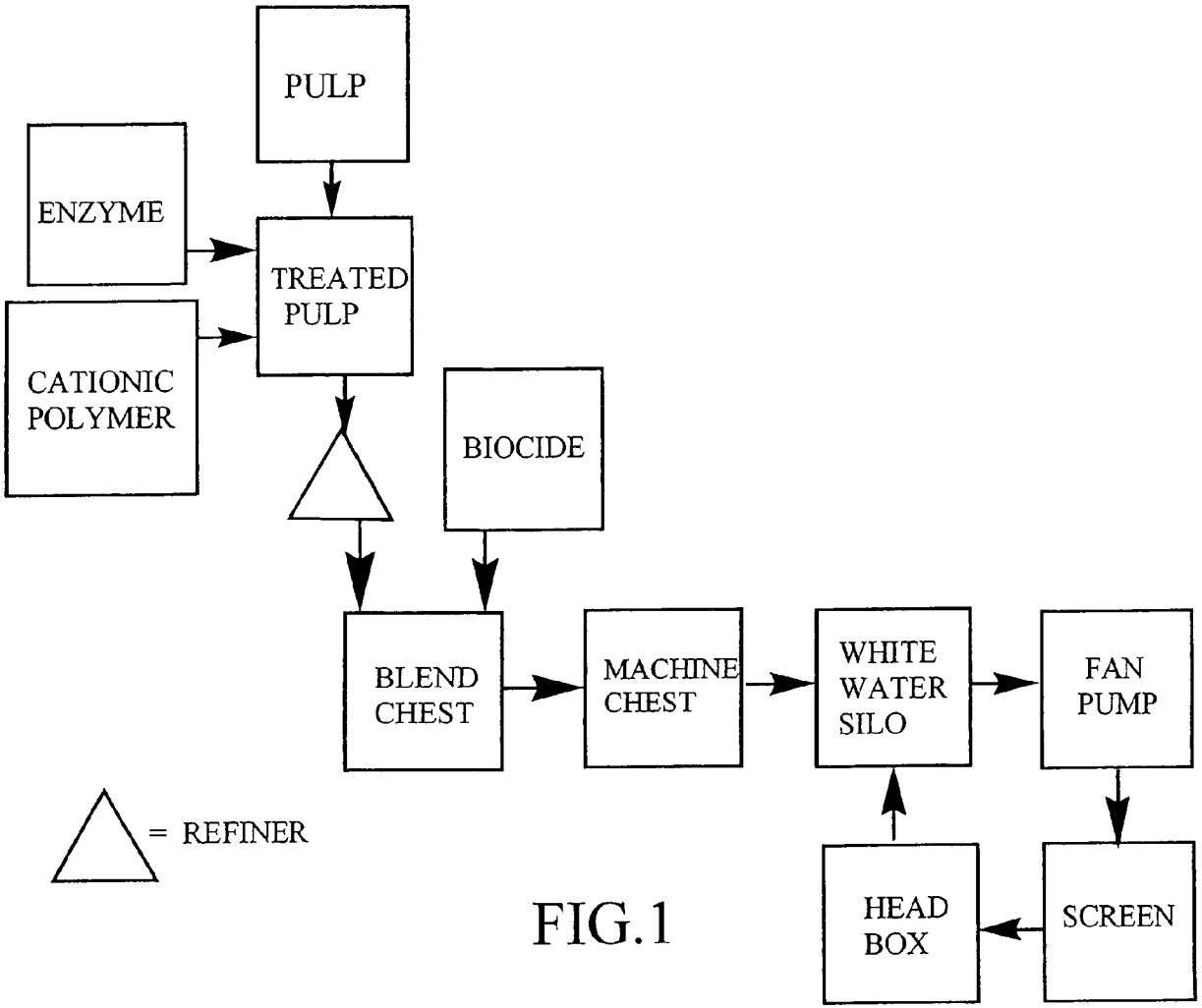
FIG. 1 is a flow chart showing a paper making process according to an embodiment of the present invention.

The present invention provides methods of making paper or paperboard. In one method, at least one cellulytic enzyme composition and at least one cationic polymer composition are introduced to a paper making pulp at about the same time. The enzyme composition and polymer composition can be added to the pulp separately, or they can be pre-combined and then added. The resulting pulp is then formed into a paper or paperboard. According to the present invention, a cationic starch can also be added to the pulp or treated pulp either at about the same time as the cationic polymer composition and enzyme composition are added, or at a later time. The cationic starch can be the same as or different from the cationic polymer added earlier. Paper and paperboard products made according to the method preferably exhibit excellent opaqueness and/or other physical properties. Sheets of pulp from which the paper and paperboard products are made preferably exhibit excellent drainage and/or excellent retention of pulp fines.

The method of the present invention can be practiced on conventional paper making machines with modifications that can be easily made in view of the present invention. The method can employ many different types of paper making pulp or combinations thereof. For example, the pulp may comprise virgin and/or recycled pulp, such as virgin sulfite pulp, broke pulp, a hardwood kraft pulp, a softwood kraft pulp, mixtures of such pulps, and the like.

As discussed above, the enzyme composition and the cationic polymer composition are added at about the same time. Preferably, adding these two components at about the same time means that the two components are added within 10 minutes of each other and more preferably are added within 5 minutes of each other and even more preferably are added within 2 minutes or within 1 minute of each other and most preferably are added essentially simultaneously to the pulp.

Furthermore, the enzyme composition and the polymer composition can generally be added at any location of the paper making process but preferably are added prior to the whitewater silo in a paper making process and more preferably are added prior to the machine chest and even more preferably are added prior to the blend chest. Most preferably, the enzyme composition and cationic polymer composition are added prior to the first refiner in a paper making process, which is generally located before the blend chest.

The enzyme composition used for treating the pulp may contain any conventional paper making pulp-treating enzyme that has cellulytic activity. Other components can be present as long as these other components do not negatively affect the cellulytic activity of the enzyme composition.

Preferably, the enzyme composition also exhibits hemicellulytic activity. Suitable enzymes and enzyme-containing compositions include those described in U.S. Pat. No. 5,356,800 to Jaquess, U.S. patent application Ser. No. 09/031,830 filed Feb. 27, 1998, and International Publication No. WO 99/43780, all incorporated herein in their entireties by reference. Other exemplary paper making pulp-treating enzymes are BUZYME® 2523 and BUZYME® 2524, both available from Buckman Laboratories International, Inc., Memphis, Tenn. The cellulytic enzyme composition preferably contains from about 5% to about 20% by weight enzyme. The preferred enzyme composition can further contain polyethylene glycol, hexylene glycol, polyvinylpyrrolidone, tetrahydrofuryl alcohol, glycerine, water, and other conventional enzyme composition additives, as for example, described in U.S. Pat. No. 5,356,800. The enzyme may be added to the pulp in an amount of from about 0.001 to about 0.100% by weight enzyme based on the dry weight of the pulp, for example, from about 0.005 to about 0.05% by weight.

In a preferred embodiment of the present invention, the enzyme composition contains at least one polyamide oligomer and at least one enzyme. The polyamide is present in an effective amount to stabilize the enzyme. Exemplary enzyme compositions containing polyamide oligomers and enzymes are described in International Published Application No. WO 99/43780, which is incorporated herein in its entirety by reference.

According to the present invention, the enzyme composition can include a combination of two or more different enzymes. The enzyme composition can include, for example, a combination of a lipase and a cellulase, and optionally can include a stabilizing agent. The stabilizing agent may be a polyamide oligomer as described herein.

The cationic polymer composition, added to the pulp at about the same time as the enzyme composition, is added in an amount effective to preferably improve the drainage or retention of the pulp compared to no cationic polymer being present. In general, the cationic polymer is added in an amount of at least about 0.5 pound cationic polymer per ton of paperstock, based on dried solids of the pulp, and preferably in an amount of at least about 1 pound per ton of paperstock. Preferably, the cationic polymer is added in an amount of from about 2 pounds per ton of paperstock to about 6 pounds per ton of paperstock, based on dried solids. The cationic polymer may preferably be added in an amount of from about 0.0001% to about 0.0100% by weight based on the dried solids weight of the pulp.

Any cationic polymer or mixture thereof may be used and preferably conventional cationic polymers commonly associated with paper making can be used in the cationic polymer composition. Examples of cationic polymers include, but are not limited to, cationic starches, cationic polyacrylamide polymers, for example, copolymers of an acrylamide with a cationic monomer, wherein the cationic monomer may be in a neutralized or quaternized form. Nitrogen-containing cationic polymers are preferred. Exemplary cationic monomers which may be copolymerized with acrylamide to form preferred cationic polymers according to the present invention, include amino alkyl esters of acrylic or methacrylic acid, and diallylamines in either, neutralized or quaternized form. Exemplary cationic monomers and cationic polyacrylamide polymers are described in U.S. Pat. No. 4,894,119 to Baron, Jr., et al., which is herein incorporated in its entirety by reference.

The cationic polymer may also be a polyacrylamide formed from comonomers that include, for example, 1-trimethylammonium-2-hydroxypropylmethacrylate methosulphate. Other examples of cationic polymers, include, but are not limited to, homopolymers of diallylamine monomers, homopolymers of aminoalkylesters of acrylic acids, and polyamines, as described in U.S. Pat. No. 4,894,119. Copolymers, ter-polymers or high forms of polymers may also be used. Further, for purposes of the present invention, a mixture of two or more cationic polymers may be used.

When the cationic polymer is a cationic polyacrylamide, nonionic acrylamide units are preferably present in the copolymer, and preferably present in an amount of at least about 30 mol % and generally in an amount of no greater than 95 mol %. At least about 5 mol %, and generally no greater than about 70 mol %, of the polymer is preferably formed from a cationic comonomer.

The weight average molecular weight of the cationic polymer is preferably over 1,000, for example, from about 10,000 to about 15,000,000, or from about 100,000 to about 10,000,000.

In a preferred embodiment of the present invention, the cationic polymer present has a weight average molecular weight of at least about 10,000 and is pre-combined with the enzyme composition before the cationic polymer composition and enzyme composition are added together to the pulp.

After treating the paper making pulp with the enzyme composition and cationic polymer composition at about the same time, the resulting treated pulp may then be processed by a conventional paper making machine and techniques. The treated pulp may be additionally treated with one or more components, including other polymers such as anionic and non-ionic polymers, clays, other fillers, dyes, pigments, defoamers, biocides, pH adjusting agents such as alum, and other conventional paper making or processing additives. One particularly preferred additive for use according to the methods of the present invention is a cationic starch.

Cationic starch may be added to the pulp or treated pulp of the present invention to form a starch treated pulp. Starch may be added at one or more points along the flow of paper making pulp through the paper making apparatus or system of the present invention. For instance, cationic starch can be added to a pulp at about the same time that the enzyme and cationic polymer are added to the pulp. The cationic starch can alternatively or additionally be added to the treated pulp after the pulp is first treated with both the enzyme and cationic polymer. Preferred cationic starches include, but are not limited to, potato starches, corn starches, and other wet-end starches, or combinations thereof.

Conventional amounts of starch can be added to the pulp. An exemplary amount of starch that can be used according to the present invention is from about 5 to about 25 pounds per ton based on the dried solids weight of the pulp.

In addition to or in place of the starch, a microparticle additive may be added to the pulp at any time during the process. The microparticle additive can modify the charge of the pulp or the charge of a component of the pulp. The microparticle additive can be, for example, a charging or modifying agent, a filler, a coagulating agent, and/or a retention aid. The microparticle additive can be a natural or synthetic hectorite, bentonite, zeolite, alumina sol, or any of conventional particulate additives as are known to those skilled in the art.

A biocide may be added to the pulp or treated pulp in accordance with conventional uses of biocides in paper making processes. For example, a biocide may be added to the treated pulp in a blend chest after the pulp has been treated with the enzyme and cationic polymer. Biocides useful in the paper making pulps according to the present invention include biocides well known to those skilled in the art, for example, BUSAN®1130, available from Buckman Laboratories International, Inc., Memphis, Tenn.

A flow chart of a paper making system for carrying out the method of the present invention is set forth in FIG. 1. It is to be understood that the system shown is exemplary of the present invention and is in no way intended to restrict the scope of the invention. In the system of FIG. 1, a supply of enzyme composition and a supply of cationic polymer composition are simultaneously combined at desired respective concentrations with a flowing stream of paper making pulp to form a treated pulp. The supply of pulp shown represents a flow of pulp, as for example, supplied from a pulp holding tank or silo. The supply of pulp shown in FIG. 1 can be a conduit, holding, or mixing tank, or other container, passageway, or mixing zone for the flow of pulp. The supply of enzyme composition can be, for example, a holding tank having an outlet in communication with an inlet of a treated pulp tank. The supply of cationic polymer composition can be, for example, a holding tank having an outlet in communication with an inlet of the treated pulp tank.

The pulp treated with the enzyme composition and cationic polymer composition is passed from the treated pulp tank through a refiner and then through a blend chest where optional additives including a biocide are combined with the treated pulp. The refiner has an inlet in communication with an outlet of the treated pulp tank, and an outlet in communication with an inlet of the blend chest.

According to the embodiment of FIG. 1, the pulp treated in the blend chest is passed from an outlet of the blend chest through a communication to an inlet of a machine chest. The blend chest and machine chest can be of any conventional type known to those skilled in the art. The machine chest ensures a level head, that is, a constant pressure on the treated pulp or stock throughout the downstream portion of the system, particularly at the head box.

In the system of FIG. 1, drained pulp resulting from paper making in the headbox is recirculated to the white water silo.

Figure 2:
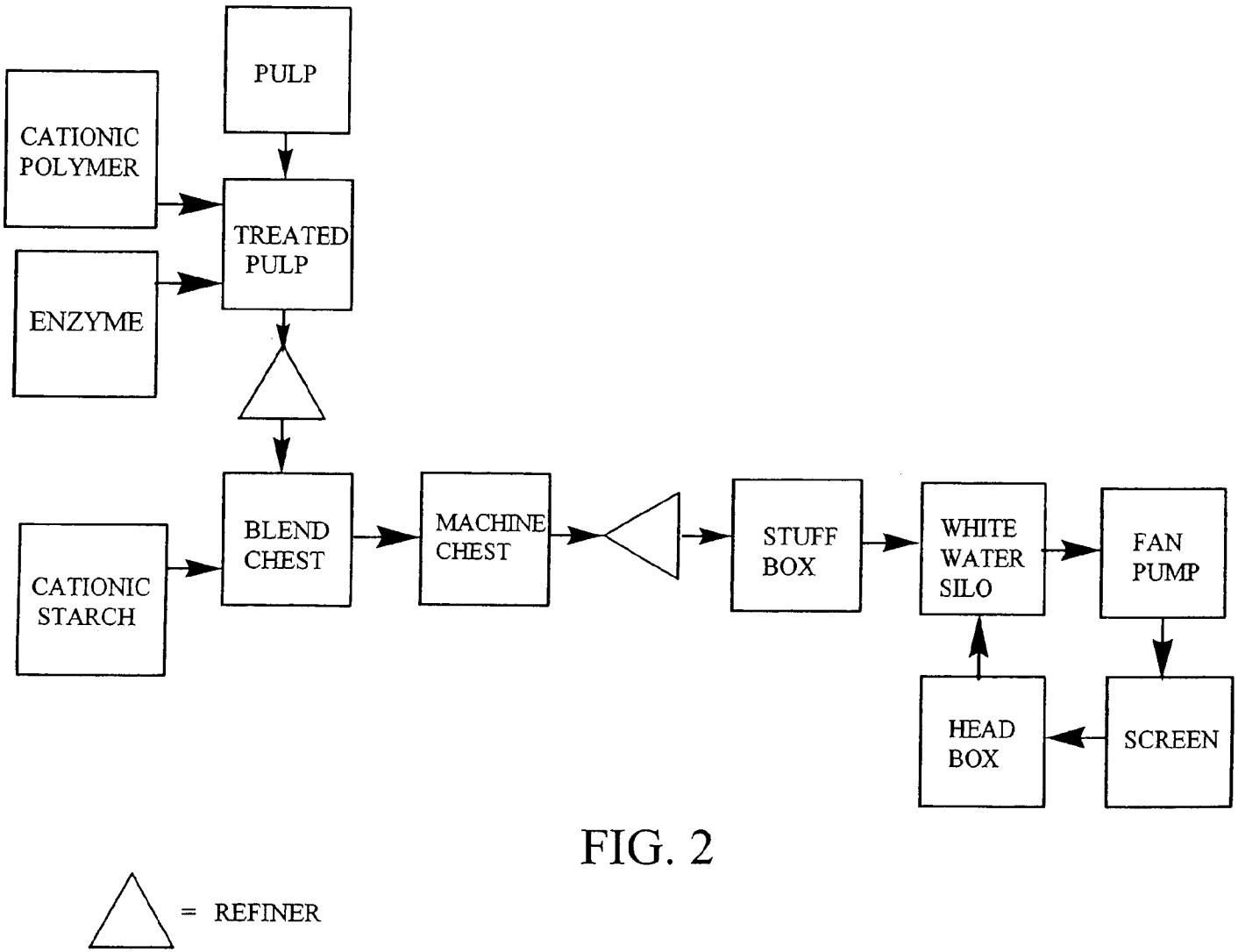
FIG. 2 is a flow chart showing a paper making process according to another embodiment of the present invention.

In the embodiment shown in FIG. 2, a cationic starch is added to the refined treated pulp at the blend chest, and the system includes a conventional stuff box. Additional cationic starch may be added at the stuff box although not depicted in FIG. 2. The system of FIG. 2 has a second refiner between the machine chest and the stuff box. Other additives, including pH adjustment agents such as alum, may also be added at the stuff box. pH adjusting agents can be added at other points along the flow of pulp or treated pulp through the apparatus.

The apparatus of the present invention can also include metering devices for providing a suitable concentration of enzyme to the flow of pulp, for example, from about 0.001 to about 0.100 percent by weight enzyme, based on the dried solids weight of the pulp. The apparatus can include a metering device for providing a suitable amount of the cationic polymer to the flow of pulp, for example, from about 0.0001 to about 1.000 percent by weight cationic polymer, based on the dried solids weight of the pulp. Other metering or dosing devices are preferably provided for the other additives and ingredients that may be used during the method.

Figure 3:
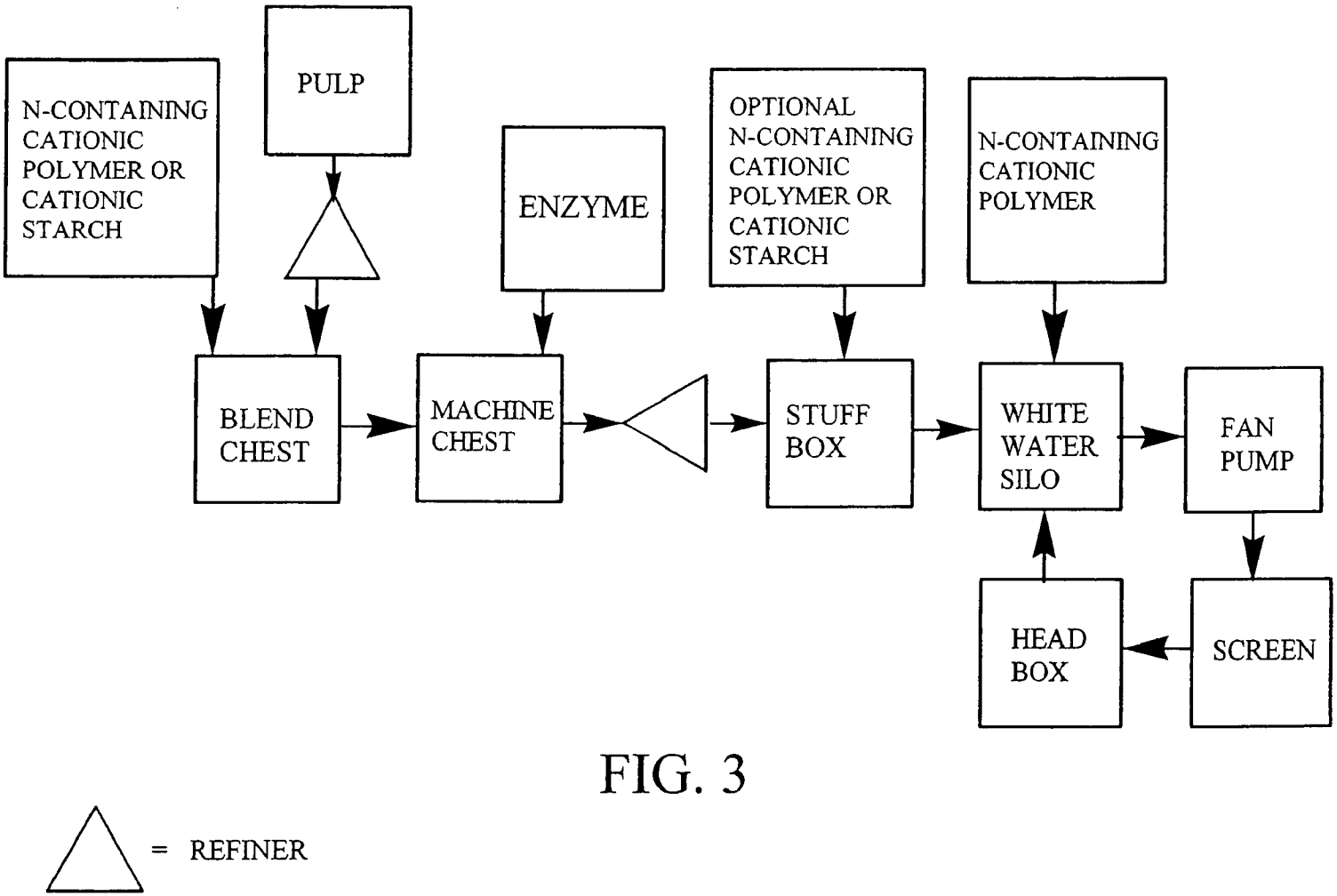
FIG. 3 is a flow chart showing a paper making process according to another embodiment of the present invention.

Another embodiment of the present invention is depicted in FIG. 3. Pulp is treated in a blend chest with a cationic polymer composition, such as a nitrogen-containing cationic polymer or a cationic starch. The treated pulp is passed from the blend chest to a machine chest wherein an enzyme composition is added to the treated pulp to form an enzyme-treated pulp. The enzyme-treated pulp is then refined and passed to a stuff box where optional cationic polymer composition is optionally added to the pulp. The optional cationic polymer composition, if used, may be the same or different than the first cationic polymer composition, added to the pulp at the blend chest. Alternatively, no additional cationic polymer is added to the pulp at the stuff box. From the stuff box, the pulp is then passed to a white water silo where a nitrogen-containing cationic polymer composition is added to the pulp. The pulp is then passed through a fan pump to a screen and subsequently to a head box. The drained stock resulting from sheet making in the head box is recirculated to the white-water silo.

According to the embodiment of the present invention shown in FIG. 3, the nitrogen-containing cationic polymer composition can be, for instance, a cationic polymer containing acrylamide units and units of a cationic monomer. The first cationic polymer composition added, on the other hand, can be a nitrogen-containing polymer, a cationic starch, or another cationic polymer. The optional cationic polymer composition can also be a nitrogen-containing polymer, a cationic starch, or another cationic polymer. The first cationic polymer composition, the nitrogen-containing cationic polymer composition, and the optional cationic polymer composition can be the same or different. According to a preferred embodiment of the present invention shown in FIG. 3, at least one of the cationic polymer compositions and the optional cationic polymer composition comprises a starch. Further, preferably the nitrogen-containing cationic polymer composition contains acrylamide units and units of a cationic monomer.

A cleaner, for example, a centrifugal force cleaning device, can be disposed between, for instance, the fan pump and the screen, according to any of the embodiments of FIGS. 1–3 above.

The method and apparatus of the present invention provide extended interaction time between the pulp, enzyme, and cationic polymer. Treated pulp reaching the headbox in the system of the present invention can be formed into a paper or paperboard precursor sheet. Preferably, the sheet exhibits excellent drainage and/or retention of fines. Resulting paper and paperboard made according to the method of the present invention exhibit excellent opaqueness and other physical properties.

It will be apparent to those skilled in the art that various modifications and variations can be made to the embodiments of the present invention without departing from the spirit or scope of the present invention. Thus, it is intended that the present invention covers other modifications and variations of this invention provided they come within the scope of the appended claims and their equivalents.

What is claimed is:

1. A method of making paper or paperboard comprising:

a) introducing at least one cellulytic enzyme composition and at least one cationic polymer composition to a paper making pulp within 5 minutes of each to form a treated pulp; and b) forming the treated pulp into paper or paperboard.

2. The method of claim 1, further comprising introducing at least one first cationic starch to the treated pulp.

3. The method of claim 1, wherein said cellulytic composition contains from about 5% to about 20% by weight enzyme.

4. The method of claim 1, wherein said cellulytic enzyme composition is added to said pulp in an amount of from about 0.001% to about 0.001% by weight enzyme based on the dry weight of the pulp.

5. The method of claim 1, wherein said cellulytic enzyme composition comprises at least one polyamide oligomer and at least one cellulytic enzyme.

6. The method of claim 1, wherein said pulp comprises a sulphite pulp.

7. The method of claim 2, wherein a second cationic starch, which is the same or different from the first cationic starch, is introduced to the treated pulp before step b).

8. The method of claim 1, wherein said at least one cationic polymer composition comprises a synthetic cationic polymer.

9. The method of claim 1, wherein said at least one cationic polymer composition comprises a polyacrylamide polymer.

10. The method of claim 1, wherein said at least one cationic polymer composition is a synthetic, water-soluble cationic polymer containing acrylamide units and cationic monomeric units.

11. The method of claim 1, wherein cationic polymer in said cationic polymer composition is added to said pulp in an amount of from about 0.001% by weight to about 1.000% by weight, based on the dried solids weight of said pulp.

12. The method of claim 2, wherein said at least one cationic starch is added to said treated pulp in an amount of from about 5 to about 25 pounds per ton based on the dried solids weight of the pulp.

13. The method of claim 1, wherein cationic polymer in said cationic polymer composition has a weight average molecular weight of at least about 10,000 and said cationic polymer composition is pre-combined with the enzyme composition before the polymer and enzyme are added together to the pulp.

14. The method of claim 1, wherein said at least one cellulytic enzyme composition and at least one cationic polymer composition are added within 1 minute of each other.

15. The method of claim 1, wherein said at least one cellulytic enzyme composition and at least one cationic polymer composition are added simultaneously.

16. The method of claim 1, wherein said at least one cellulytic enzyme composition and at least one cationic polymer composition are added prior to a blend chest in a paper making process.

17. The method of claim 16, wherein said at least one cellulytic enzyme composition and at least one cationic polymer composition are added prior to a first refiner which is located before the blend chest.

18. The method of claim 16, further comprising introducing at least one first cationic starch to the treated pulp prior to the blend chest.

19. The method of claim 18, further comprising introducing at least a second cationic starch to the treated pulp and wherein said first and second cationic starches are the same or different.

20. The method of claim 16, wherein said at least one cationic polymer composition comprises a synthetic polymer having at least one nitrogen-containing polymer.

21. The method of claim 1, wherein said pulp is a virgin sulfite pulp.

22. A method of making paper or paperboard comprising:

a) introducing a cationic polymer composition to a pulp to form treated pulp;

b) introducing at least one cellulytic enzyme composition to said treated pulp to form an enzyme-treated pulp;

c) adding a nitrogen-containing cationic polymer composition to the enzyme-treated pulp; and d) forming the pulp into paper or paperboard.

23. The method of claim 22, further comprising introducing a second cationic polymer composition to the enzyme-treated pulp prior to introducing the nitrogen-containing cationic polymer composition to the enzyme-treated pulp.

24. The method of claim 22, wherein said cationic polymer composition comprises a nitrogen-containing polymer or a starch.

25. The method of claim 23, wherein said second cationic polymer composition comprises a nitrogen-containing polymer or a starch.

26. The method of claim 22, wherein said cellulytic enzyme composition contains from about 5% to about 20% enzyme.

27. The method of claim 22, wherein said enzyme in said enzyme composition is added to said pulp in an amount of from about 0.001% to about 0.100% by weight enzyme based on the dried solids weight of the pulp.

28. The method of claim 22, wherein said enzyme composition comprises at least one polyamide oligomer and at least one cellulytic enzyme.

29. The method of claim 22, wherein said pulp comprises a sulfite pulp.

30. The method of claim 22, wherein said cationic polymer in said cationic polymer composition is added to said pulp in an amount of from about 0.0001% by weight to about 1.000% by weight, based on the dried solids weight of said pulp.

31. The method of claim 22, wherein said cationic polymer composition is introduced at the blend chest in a paper making process and said at least one cellulytic enzyme composition is introduced at the machine chest of the same paper making process and said nitrogen-containing cationic polymer composition is added to about the whitewater silo in the same paper making process.

32. The method of claim 31, wherein said optional cationic polymer is introduced at the stuff box which is located between said machine chest and said whitewater silo.

* * * * *

UNITED STATES PATENT AND TRADEMARK OFFICE

CERTIFICATE OF CORRECTION

PATENT NO. : 6,939,437 B1
DATED : September 6, 2005
INVENTOR(S) : Hill, Jr. et al.

It is certified that error appears in the above-identified patent and that said Letters Patent is hereby corrected as shown below:

Column 6,
Line 66, "0.001%" (first occurrence) should read -- 0.100% --.

Column 7,
Line 21, "0.001%" should read -- 0.0001% --.

Column 8,
Line 48, "to" should read -- at --.

Signed and Sealed this

Eighth Day of November, 2005

JON W. DUDAS
*Director of the United States Patent and Trademark Office*